United States Patent [19]

Gillich et al.

[11] 4,448,647

[45] May 15, 1984

[54] ELECTROCHEMICALLY TREATED METAL PLATES

[75] Inventors: Thomas N. Gillich, Whitehouse Station; John E. Walls, Annandale; Stanley F. Wanat, Scotch Plains; William J. Rozell, Martinsville, all of N.J.

[73] Assignee: American Hoechst Corporation, Somerville, N.J.

[21] Appl. No.: 424,685

[22] Filed: Sep. 27, 1982

Related U.S. Application Data

[63] Continuation of Ser. No. 188,091, Sep. 26, 1980, abandoned.

[51] Int. Cl.[3] ..... C25D 11/02; C25D 11/08; C25D 11/10

[52] U.S. Cl. ..... 204/33; 204/32 R; 204/32 S; 204/38 A; 204/56 R; 204/56 M; 430/278; 101/454; 101/456; 101/459; 101/458

[58] Field of Search ..... 204/32 R, 32 S, 56 R, 204/56 M, 33, 58, 38 A, 38 E; 430/278; 101/454, 456, 458, 459

[56] References Cited

U.S. PATENT DOCUMENTS

| | | | |
|---|---|---|---|
| 2,578,400 | 12/1951 | Cohn | 204/38 |
| 2,918,416 | 12/1959 | Taylor | 204/58 |
| 3,275,537 | 9/1966 | Petin | 204/58 |
| 3,307,951 | 3/1967 | Adams | 96/86 |
| 3,620,939 | 11/1971 | Fruchtnicht | 204/56 M |
| 3,756,826 | 9/1973 | Zelley | 96/86 |
| 3,844,908 | 10/1974 | Matsuo et al. | 204/58 |
| 3,857,766 | 12/1974 | Woods | 204/58 |
| 4,153,461 | 5/1979 | Berghäuser | 96/75 |

FOREIGN PATENT DOCUMENTS

| | | | |
|---|---|---|---|
| 1251616 | 4/1968 | Fed. Rep. of Germany | 204/58 |

*Primary Examiner*—R. L. Andrews

*Attorney, Agent, or Firm*—Richard S. Roberts; Leo S. Burnett

[57] ABSTRACT

According to the invention there is provided an electrochemical process for applying a firmly bonded insoluble metal oxide-organic complex on a metal surface by employing the metal as anode and a water-soluble poly basic organic acid as electrolyte together with a strong inorganic acid such as phosphoric acid or further admixed with another strong inorganic acid such as sulfuric. The polybasic acid may be a polyphosphonic acid, polyphosphoric and polycarboxyl acid, or polysulfonic acid and is advantageously polymeric. Polyvinyl phosphonic acid (PVPA) is a preferred electrolyte. Direct current is used. The insoluble metal oxide-organic complex formed is composed of anodic oxide combined with polyacid, which forms a protective layer on the metal of improved corrosion resistance. The metal oxide-organic complex is well-suited to bond light sensitive coatings thereto. The metal may be steel or aluminum. The process is economical and the product novel.

58 Claims, No Drawings

ELECTROCHEMICALLY TREATED METAL PLATES

This application is a continuation of U.S. patent application Ser. No. 188,091 filed on Sept. 26, 1980 now abandoned.

TECHNICAL FIELD

This invention relates to simultaneous anodizing and sealing the surface of metal sheets with novel electrolytes and the products thereby obtained. The resulting anodized and sealed metal sheets have improved corrosion resistance and are suitable, among other uses, for architectural applications. When further used as supports in lithography, particularly if aluminum or its alloys are selected, such sheets exhibit improved adhesion for light sensitive coatings, improved run length, and lessened wear on the press both in image and non-image areas, greater shelf life and improved hydrophilicity in non-image areas. Such anodically generated coatings are more economically obtained than with conventional anodizing.

BACKGROUND OF PRIOR ART

Anodization is an electrolytic process in which the metal is made the anode in a suitable electrolyte. When electric current is passed, the surface of the metal is converted to a form of its oxide having decorative, protective or other properties. The cathode is either a metal or graphite, at which the only important reaction is hydrogen evolution. The metallic anode is consumed and converted to an oxide coating. This coating progresses from the solution side, outward from the metal, so the last-formed oxide is adjacent to the metal. The oxygen required originates from the electrolyte used.

Although anodizing can be used for other metals, aluminum is by far the most important. Magnesium can be anodized by processes similar to those used for aluminum. Zinc can be "anodized" but the process is not truly comparable, depending upon a high voltage discharge that produces a pitted semifused surface. Several other metals, including copper, silver, cadmium, titanium, and steel can be treated anodically for decorative effects.

Anodic oxide coatings on aluminum may be of two main types. One is the so-called barrier layer which forms when the anodizing electrolyte has little capacity for dissolving the oxide. These coatings are essentially nonporous; their thickness is limited to about 13 Å/volt applied. Once this limiting thickness is reached, it is an effective barrier to further ionic or electron flow. The current drops to a low leakage value and oxide formation stops. Boric acid and tartaric acid are used as electrolytes for this process.

When the electrolyte has appreciable solvent action on the oxide, the barrier layer does not reach its limiting thickness: current continues to flow, resulting in a "porous" oxide structure. Porous coatings may be quite thick: up to several tens of micrometers, but a thin barrier oxide layer always remains at the metal-oxide interface.

Electron microscope studies show the presence of billions of closepacked cells of amorphous oxide through the oxide layer, generally perpendicular to the metal-oxide interface.

Sulfuric acid is the most widely used electrolyte, with phosphoric also popular. Anodic films of aluminum oxide are harder than air-oxidized surface layers.

Anodizing for decorative, protective and adhesive bonding properties has used strong electrolytes such as sulfuric acid and phosphoric acid. U.S. Pat. No. 2,703,781 employs a mixture of these two electrolytes.

U.S. Pat. No. 3,227,639 uses a mixture of sulfophthalic and sulfuric acids to produce protective and decorative anodic coatings on aluminum. Other aromatic sulfonic acids are used with sulfuric acid in U.S. Pat. No. 3,804,731.

As a post-treatment after anodization, the porous surface is sealed according to numerous processes to determine the final properties of the coating. Pure water at high temperature may be used. It is believed that some oxide is dissolved and reprecipitated as a voluminous hydroxide (or hydrated oxide) inside the pores. Other aqueous sealants contain metal salts whose oxides may be coprecipitated with the aluminum oxide. U.S. Pat. No. 3,900,370 employs a sealant composition of calcium ions, a water-soluble phosphonic acid which complexes with a divalent metal to protect anodized aluminum or anodized aluminum alloys against corrosion. Polyacrylamide has been proposed as a sealant.

U.S. Pat No. 3,915,811 adds an organic acid (acetic acid, hydroxy acetic acid, or amino acetic acid) to a mixture of sulfuric and phosphoric acids to form the electrolyte in preparation for electroplating the so-formed anodic aluminum coating.

U.S. Pat. No. 4,115,211 anodizes aluminum by A.C. or superimposed A.C. and D.C. wherein the electrolyte solution contains a water-soluble acid and a water-soluble salt of a heavy metal. The water-soluble acid may be oxalic, tartaric, citric, malonic, sulfuric, phosphoric, sulfamic or boric.

U.S. Pat. No. 3,988,217 employs an electrolyte containing quaternary ammonium salts, or aliphatic amines and a water-soluble thermosetting resin to anodize aluminum for protective, ornamental or corrosion resistant applications.

The advantages of anodized aluminum as a carrier for lithographic printing plates were early recognized. Processes employing as electrolytes sulfuric acid, phosphoric acid, mixtures of these, or either of these in succession have been proposed. Prior to anodizing the sheet may be roughened mechanically or chemically. The need for a subcoating prior to application as a photosensitive layer to impart adhesion to coating and hydrophilicity to the non-image areas was recognized. U.S. Pat. No. 3,181,461 uses an aqueous alkaline silicate treatment following the anodization step.

U.S. Pat. No. 2,594,289 teaches (Col. 1, lines 42–54) that porous anodic films but not nonporous anodic films are suitable for lithographic purposes, "since the porous film confers a better water receptive surface to the non-image areas of the plate and allows image-forming material to anchor effectively to the surface by penetrating the pores."

U.S. Pat. No. 3,511,661, since disclaimed, describes aluminum sheet for a lithographic printing surface anodized in aqueous phosphoric acid having an anodic film with a cellular pattern of aluminum oxide having cells with porous openings of about 200 Å to 700 Å in average diameter and a surface with 10 to 200 mg per square meter of aluminum phosphate.

U.S. Pat. No. 3,658,662 describes the electrochemical silication of a cleaned, etched aluminum plate to achieve a measure of hydrophilization.

In U.S. Pat. No. 3,902,976 a conventionally anodized aluminum sheet is electrolytically post-treated in an aqueous solution of sodium silicate to form a hydrophilic abrasion-resistant and corrosion-resistant layer suitable as a support for a presensitized lithographic sheet.

U.S. Pat. No. 4,022,670 carries out anodization of aluminum sheets in an aqueous solution of a mixture of polybasic mineral acid such as sulfuric and a higher concentration of a polybasic aromatic sulfonic acid such as sulfophthalic acid to produce a porous anodic oxide surface to which a photosensitive layer may be directly applied.

There is described in U.S. Pat. No. 4,090,880, a two-step process whereby a cleaned aluminum sheet if first coated with an interlayer material such as alkali silicate, Group IV-B metal fluorides, polyacrylic acid, or alkali zirconium fluoride and then anodized conventionally in aqueous sulfuric acid. Enhanced shelf life when overcoated with diazo sensitizers is claimed.

U.S. Pat. No. 4,153,461 employs a post-treatment with aqueous polyvinyl phosphonic acid at temperatures from 40° to 95° C. after conventional anodizing to a thickness of at least 0.2 u. The treatment provides good adhesion of a subsequently applied light sensitive layer, good shelf life and good hydrophilization of non-image areas after exposure and development as well as long press runs.

Plates of the above construction, particularly when the light sensitive layer is a diazo compound have enjoyed considerable commercial success. Nevertheless, certain improvements would be desirable. These include freedom from occasional coating voids, occasional unpredictable premature image failure on the press, faster, more dependable roll-up on the press and freedom from other inconsistencies. Still greater press life is desirable as well as a process that would be more economical than conventional anodizing followed by a second operation of sealing or post-treating in preparation for coating with a light sensitive layer.

In the case of protective and decorative applications, improved corrosion resistance and production economy over known anodizing processes is desired.

SUMMARY OF THE INVENTION

According to the invention there is provided an electrochemical process for applying a firmly bonded insoluble metal oxide-organic complex on a metal surface by employing the metal as anode and a water-soluble polybasic organic acid as electrolyte together with a strong inorganic acid such as phosphoric acid or further admixed with another strong inorganic acid such as sulfuric. The polybasic acid may be a polyphosphonic acid, polyphosphoric and polycarboxyl acid, or polysulfonic acid and is advantageously polymeric. Polyvinyl phosphonic acid (PVPA) is a preferred electrolyte. Direct current is used. The insoluble metal oxide-organic complex formed is composed of anodic oxide combined with polyacid, which forms a protective layer on the metal of improved corrosion resistance. The metal oxide-organic complex is well-suited to bond light sensitive coatings thereto. When used as a lithographic support the shelf life, lithographic properties and press life are improved over the products of previous processes. The metal may be steel or aluminum. The process is economical and the product novel.

Transmission electron microscopy (TEM) of at least 55,000 times magnification of aluminum oxide films obtained according to the invention shows no porosity of the surface of the product of the invention, whereas conventionally anodized aluminum shows typical porosity at as little as 5,000 times magnification. Further, ESCA (Electron Spectroscopy for Chemical Analysis) examination of polyvinyl phosphonic acid treated aluminum shows a high ratio of phosphorus to aluminum (P/Al) in the metal oxide-organic complex surface film. In contrast, conventionally anodized aluminum using even phosphoric acid has a very low P/Al ratio. Conventionally anodized aluminum post-treated by simple thermal immersion in aqueous polyvinyl phosphonic acid (non-electrochemical) has an intermediate, significantly lower P/Al ratio. This is evidence of the incorporation of the electrolyte molecules into the structure of the insoluble metal oxide-organic complex which comprises the surface film of the products of this invention.

Copending application Ser. No. 188,092 filed on Sept. 26, 1980 is concerned with electrolytic processes wherein the organic electrolyte acids are the sole electrolytes and provide substrate products having improved corrosion resistance, improved hydrophilicity and non-porous surfaces. Said copending application is explicitly made part of this application by reference.

DETAILED DESCRIPTION OF THE INVENTION AND PREFERRED EMBODIMENTS

The metal substrates to be subjected to electrochemical treatment according to the invention are first cleaned. Cleaning may be accomplished by a wide range of solvent or aqueous alkaline treatments appropriate to the metal and to the final end-purpose.

Typical alkaline degreasing treatments include: hot aqueous solutions containing alkalis such as sodium hydroxide, potassium hydroxide, trisodium phosphate, sodium silicate, aqueous alkaline and surface active agents. A proprietary composition of this type is Ridolene 57, manufactured by Amchem Products, Pennsylvania. Currently less popular because of environmental and health considerations, is solvent degreasing, using trichloroethylene, 1,1,1-trichloroethane, and perchloroethylene. Solvent degreasing is accomplished by immersion, spray or vapor washing. Included among suitable metals are steel, magnesium, or aluminum or its alloys. Aluminum alloy 1100, 3003 and A-19, product of Consolidated Aluminum Company among others, may be used for lithographic purposes and are preferred. Typical analyses of these three lithographic alloys are shown on a weight percent basis:

| Alloy | Al | Mg | Mn | Fe | Si | Cu |
|---|---|---|---|---|---|---|
| 1100 | 99.2 | — | — | :375 | .375 | .05 |
| 3003 | 99.0 | — | .7 | .15 | .2 | .05 |
| A-19 | 98.3 | .9 | — | .375 | .375 | .05 |

It is surmised that the specific chemical composition of the alloy may have an influence upon the effectiveness of electrodeposition of organic electrolytes. Further other components not usually analyzed may also have an influence.

The metal surface may be smooth or roughened. Conventional surface roughening techniques may be employed. They include but are not restricted to chemical etching in alkaline or acid solutions, graining by dry abrasion with metal brushes, wet abrasion with brushes and slurries of abrasive particles, ball graining and electrochemical graining. The surface roughness and topography varies with each of these processes. For best results according to the practice of this invention, the clean surface should be immediately electrotreated before the formation of an aerial oxide. Prior to immersion of a previously cleaned, degreased and optionally roughened plate in the organic electrolyte solution for electrodeposition, the plate should be etched to remove aerial oxide. Such etching can be accomplished by known etching means including acid and alkaline and electrolytic treatments with the above followed by rinsing. A method for removal of aerial oxide is stripping the plate with a standard etchant such as phosphoric acid/chromic acid solution. Thus immediately after cleaning and roughening (if this step is desired) and etching it is preferable that the metal surface should be rinsed with water and electrotreated while still wet, although useful products may be obtained if this precaution is not rigidly adhered to.

After cleaning and after roughening, if desired, the metal may be optionally anodized conventionally prior to electrodeposition of the organic electrolyte of this invention admixed with a phosphorus oxo acid having POH groups(s) in which the hydrogen atom is ionizable, further admixed with another strong inorganic acid such as sulfuric. Such acids include phosphoric acid and phosphorous acid.

Organic electrolytes which are suitable for improvement of corrosion resistance according to this invention include sulfonic acids, phosphonic acids, phosphoric acids and carboxylic acids which are at least tribasic, both monomeric and polymeric and mixtures of the above. Specific electrolytes include nitrilo triacetic acid 1,2,4,5-benzene tetracarboxylic acid, condensation product of benzene phosphonic acid and formaldehyde (polybenzene phosphonic acid), co-polymers of methylvinyl ether and maleic anhydride at various molecular weights, copolymer of methylvinyl ether and maleic acid, polyvinyl sulfonic acid, polystyrene sulfonic acid, phytic acid, alginic acid, poly-n-butyl benzene sulfonic acid, poly diisopropyl benzene sulfonic acid, polyvinyl phosphonic acid, dodecylpolyoxy ethylene phosphonic acid, tridecyl benzene sulfonic acid, dinonyl naphthalene disulfonic acid, 2,2'-dinitro-4,4'-stilbene disulfonic acid, diisopropyl polynaththalene disulfonic acid, 2-ethylhexyl phosphonic acid, dodecyl naphthalene disulfonic acid, di-n-butyl naphthalene disulfonic acid, polydecyl benzene sulfonic acid, polyacrylic acid, polymethacrylic acid, diethylene diamine pentaacetic acid, polynaphthalene sulfonic acid, ethylenediamine tetraacetic acid, hydroxyethyl ethylenediamine triacetic acid, and mixtures of any of the foregoing. All of the above are water-soluble.

For lithographic applications, a high degree of hydrophilicity and firm adhesion of the image is necessary. Preferable electrolytes when admixed with a strong inorganic acid comprising phosphoric acid include the condensation product of benzene phosphonic acid and formaldehyde, lower molecular weight copolymers of methylvinyl ether and maleic anhydride, copolymers of methylvinyl ether and maleic acid, polyvinyl sulfonic acid, phytic acid, polyvinyl phosphonic acid, dodecyl polyoxy ethylene phosphonic acid, diisopropyl polynaphthalene sulfonic acid, 2-ethylhexyl phosphonic acid, ethylenediamine tetra acetic acid, hydroxy ethylethylene diamine triacetic acid and mixtures of any of the foregoing.

Most preferred when admixed with a strong inorganic acid comprising a phosphorus oxo acid having POH groups in which the hydrogen atom is ionizable, particularly for critical lithographic applications include the condensation product of benzene phosphonic acid and formaldehyde, phytic acid, polyvinyl phosphonic acid, 2-ethylhexyl polyphosphoric acid and mixtures of any of the foregoing.

Mixtures of any of the aforementioned organic electrolytes with said phosphorus oxo acid are used in this invention. Alternative to the use of a single organic acid with a strong mineral acid, there may be employed a mixture of one or more such organic acids. As a further alternative there may be added another strong inorganic acid provided that a phosphorus oxo acid be always present. The characteristics of the invention are the initial surge in current during electrodeposition followed by a fall to much lower level (to about 2 amps as shown in the examples), and a nonporous surface as shown by transmission electron microscopy. The benefits are an increased corrosion resistance as shown by the potassium zincate test, and greatly improved hydrophilicity in appropriate tests described below, and comparable printing run lengths at appreciably lower electrodeposited coating weights compared to conventional anodizing.

Conventionally anodized products, in contrast, do not show the initial current surge as markedly and the drop in current is less severe, leveling off at its steady state at a much higher level typically 10–15 amperes. Such anodic coatings have characteristic porosity and corrosion resistance and are not sufficiently hydrophilic until given supplementary treatments. By the addition of an effective or sufficient concentration of the above organic acids to phosphoric acid, or to a mixture of phosphoric and sulfuric acids, the desirable characteristics may be obtained and recognized by the test procedures described herein.

Typically, although dependent upon the total composition, the addition of at least about 0.25% of organic acid produces the products of this invention if the inorganic acid is phosphoric although a minimum of 0.5% is preferable. In the case of ternary mixtures of phosphoric, sulfuric and organic acid, the addition of at least about 0.5% of organic acid is desirable while 1% is preferable to obtain nonporous surfaces.

The concentration of the electrolyte, the electrolysis conditions used, e.g. voltage, current density, time, temperature all play significant roles in determining the properties of the coated metal.

The integrity and freedom from porosity of the metal oxide-organic complex of which the electrodeposited film is composed may be measured by the potassium zincate test for anodized substrates. This test is described in U.S. Pat. No. 3,940,321. A solution of potassium zincate (ZnO 6.9%, KOH 50.0%, $H_2O$ 43.1%) is applied to the surface of the coating. An untreated plate gives a rapid reaction to form a black film. As a barrier layer is formed, the time for the zincate solution to react is increased. For comparison, an aluminum plate anodized in sulfuric acid to an oxide weight of 3.0 g/$M^2$ will show a reaction in about 30 seconds. The plate anodized in phosphoric acid having an oxide weight of ca. 1.0 g/M$^2$ will take about two minutes to react. Tests with electro-treated plates using polyvinyl phosphonic acid as the electrolyte added to strong inorganic acid, consistently take substantially longer to react, unless very low extremes of concentration or operating conditions are used. It has been found that the zincate test gives clearly recognizable end points for anodic coatings of the prior art, say up to about one minute. The products of this invention produce more difficulty in recognizing end points, particularly as the reaction time increases.

Conventionally anodized aluminum using sulfuric acid and/or phosphoric acid as electrolyte has been used for architectural applications because of superior resistance to weathering. For the aluminum sheets of this invention potassium zincate test times are about 90 seconds for a 1% solution of organic electrolyte mixed with a strong inorganic acid. The zincate test is believed to correlate with corrosion resistance, a key property in protective and decorative metal applications.

The metal-organic complex film weight is determined quantitatively by stripping with a standard chromic acid/phosphoric acid bath (1.95% $CrO_3$, 3.41% of 85% $H_3PO_4$) balance $H_2O$ at 180° F. for 15 minutes.

The bonding of an electrolytically deposited film is much greater than when prior art thermal immersion is used after anodizing. A 1.0 N NaOH solution removes most of such thermally deposited coating but virtually none of an electrolytically deposited film which is therefore insoluble in reagents of equal or lower aggressiveness.

For lithographic applications, plates are tested after electrodeposition of the metal oxide-organic complex and before coating with a light sensitive layer. The plate is wet or dry inked, the latter test being more severe. After inking, the plate is rinsed under running water or sprayed with water and lightly rubbed. The ease and completeness of ink removal indicates the hydrophilicity of the surface.

Typically, plates prepared in accordance with the invention, when dry inked and baked in an oven at 100° C., rinsed totally free of ink. By contrast, plates either unanodized or conventionally anodized and then subjected to a thermal immersion in an aqueous solution of polyvinyl phosphonic acid are irreversibly scummed when aged even under less severe conditions.

Using the inking tests, plates both with and without photosensitive coatings are aged at various times and temperatures and checked for retention of hydrophilic properties. Plates coated with various diazo coatings were checked by aging for stepwedge consistency, resolution, retention of background hydrophilicity, and ease of development. Suitable light sensitive materials will be discussed below.

Finally, for lithographic applications, plates including controls, are run on press. Differences in topwear, dot sharpening, stepwedge rollback, speed and cleanliness of roll-up, and length of run are observed. In general, in all cases, plates electrodeposited within an extensive range of concentration, time, temperature, voltage, and current density are superior to prior art plates with little criticality in the variables being shown. However, within the confines of the invention, certain variables proved more important than others and certain parameters of those variables were more critical in obtaining best results. This is discussed in more detail below.

The succession of events with increased time in a typical electrodeposition trial may be described. For example, an electrolyte composed of 100 g/l phosphoric acid with polyvinyl phosphonic acid at 1% concentration is used at a temperature of 20° C. at 10 volts D.C. with a cleaned and etched aluminum plate as the anode and a carbon rod as the cathode.

The aluminum oxide-organic complex which comprises the surface film forms very rapidly at first.

During this period the voltage remains substantially constant.

The amperage is not a prime variable but is set by the other conditions selected, particularly the voltage and electrolyte concentration. The amperage begins to decline very shortly after the beginning of electrolysis.

The picture is that of a self-limiting process, in which an electrodeposited barrier layer is formed composed of a metal-organic complex, which restricts the further flow of current. The restriction is not as severe as in the case of boric acid anodization, in which the maximum film thickness is 13–16 Å/volt as found by typical surface analytical techniques, i.e., Auger analysis with ion sputtering for depth profile.

The potassium zincate test is proportional to the coating weight gain.

It is believed, based upon experiments at various voltages and times, that the metal oxide-organic complex film upon the metal surface acts as a capacitor.

The boundary of conditions will therefore depend upon the process variables selected. Within this boundary, readily tested by procedures disclosed, there lies the most preferred conditions for the performance of the inventive process and the obtaining of the corresponding products. However, it should be remembered that within a much wider range of conditions which are comparatively non-critical, there are obtained products all of which are improvements over the prior art.

Binary systems of phosphoric acid with organic acids may range in concentration from about 10 g/l of $H_3PO_4$ to about 200 g/l of $H_3PO_4$. A preferred range is from about 20 g/l of $H_3PO_4$ to 100 g/l. To this is added at least about 0.25% of organic acid and preferably at least about 0.5% to secure the above described characteristics and benefits in the electrodeposited metal sheet.

In the case of ternary systems in which another strong inorganic acid such as sulfuric or phosphorous acid is added to phosphoric acid, such mixture may vary over the entire composition range. High $H_2SO_4/H_3PO_4$ ratios require more organic acid to ensure nonporosity, i.e., greater than about 1%; however, very high $H_2SO_4/H_3PO_4$ may prevent formation of a nonporous film. Lower $H_2SO_4/H_3PO_4$ ratios need only about 0.5% of organic to achieve nonporosity. In any event, there is no harm in the use of a higher organic acid content.

When the inorganic acid content is sufficiently low, in all cases a nonporous coating will be formed by electrodeposition, determined primarily by the concentration of the organic acid. In fact, at zero inorganic acid content, the electrolytes become identical to those of copending Ser. No. 188,092 filed on Sept. 26, 1980.

Current carrying capacity increases rapidly with concentration, resulting in shorter process times and lower voltage requirements.

There is a reasonably linear relationship between the weight of insoluble metal oxide-organic complex film formed and the direct current voltage employed. At all voltages over about 5 volts, the electrodeposited film that is formed confers corrosion resistance and lithographic properties superior to prior art.

Direct current is required for the process, although alternating current may be superimposed. Square waves from pulse plating sources are particularly useful.

Amperage is at a maximum at the beginning of electrodeposition and declines with time as the metal oxide-organic complex film builds upon the metal surface and reduces current carrying capacity. Within 30 seconds it has declined to a level at which further current consumption decreases. This is a major factor in processing economy, as a useful, desirable film has already been deposited.

Electrodeposition voltages range from 5 VDC to 75 VDC and higher. High electrodeposited coating weights are more readily obtained in the presence of a strong inorganic acid; hence, neither high voltages, nor long treatment times are nacessary. To achieve the desired products of this invention, voltages from about 5 VDC to about 40 VDC for both binary systems and ternary systems are preferred.

Amperage is thus a dependent variable, which electrolyte identity, concentration and voltage the independent variables. Current densities of from about 0.2 amperes/$dm^2$ to about 6 amperes/$dm^2$ are characteristic of favorable process operating conditions and are preferred.

The temperature at which the process is conducted may range from about −2° C. (near the freezing point of the electrolyte) to about 60° C. Best results are based on tests of lithographic properties. Operation at very low temperatures would require expensive cooling capacity. Accordingly, a temperature range between about 10° C. and 35° C. is preferred and an operating temperature of about 20° C. to about 25° C. is still further preferred because of operating economy and minimal loss of performance.

From a process point of view the short time, low temperature (room temperature with little need for auxiliary heating or cooling) and low current consumption are all favorable economic factors compared to conventional anodizing followed by thermal substrate treatments characteristic of prior art processes.

Light sensitive compositions suitable for preparation of printing forms by coating upon the metal oxide-organic complex films of this invention include iminoquinone diazides, o-quinone diazides, and condensation products of aromatic diazonium compounds together with appropriate binders. Such sensitizers are described in U.S. Pat. Nos; 3,175,906; 3,046,118; 2,063,631; 2,667,415; 3,867,147 with the compositions in the last being in general preferred. Further suitable are photopolymer systems based upon ethylenically unsaturated monomers with photoinitiators which may include matrix polymer binders. Also suitable are photodimerization systems such as polyvinyl cinnamates and those based upon diallyl phthalate prepolymers. Such systems are described in U.S. Pat. Nos. 3,497,356; 3,615,435; 3,926,643; 2,670,286; 3,376,138 and 3,376,139.

It is to be emphasized that the aforementioned specific light sensitive systems which may be employed in the present invention are conventional in the art. Although all compositions are useful, the diazos are generally preferred as they tend to adhere best to the metal-organic complex and to exhibit higher resolution in printing.

The physical appearance of the surfaces of electrodeposited coatings of organic electrolytes of this invention has been examined by transmission electron microscopy. When viewed at magnifications of at least 55,000×, a nonporous surface is seen. In contrast, conventionally anodized surfaces show typical pores at as little as 5,000 magnification. Accordingly, when the term "nonporous" is used herein, it is meant that pores are not visible at 55,000× magnification 35 using transmission electron microscopy.

Physical-chemical analysis by ESCA (Electron Spectroscopy for Chemical Analysis) has been described above and shows that the electrolyte is tightly bonded with metal oxide to the surface of the metal surface to form an insoluble metal oxide-organic complex.

ESCA results with binary and ternary systems with PVPA treated aluminum show phosphorus/aluminum ratios comparable to thermally treated samples (0.6 to 0.9:1) and in some instances even much higher ratios (as high as 2:1).

A third form of analysis uses the Auger technique to determine the thickness of the layer formed on the surface of the metal by electrochemical action. The thickness of layers of constant composition can be measured and compared for the different electrochemical processes. As the voltage used in each process is known, results can be stated in Å/volt.

Typical barrier layers using boric and tartaric acids have thicknesses of 13 Å–16 Å/volt and are nonporous.

Conventionally anodized aluminum using sulfuric acid or phosphoric acid has thicknesses of 100–150 Å/volt and is porous as determined by TEM.

Aluminum electrolyzed in a solution of 100 g/l $H_3PO_4$ with a 1% polyvinyl phosphonic acid (typical electrolyte of this invention) develops a coating of 100 Å/volt at 25 volts, and is nonporous. It must be remembered that the coating develops very rapidly. Thus the products of this invention are nonporous, have coating thicknesses of about 100 Å/volt or more and at least when phosphonic acids are used as co-electrolyte, additionally 20 have high phosphorus to aluminum ratios showing the incorporation of molecules of the electrolyte together with metal oxide in the insoluble metal oxide-organic complex of which the electrodeposited coating is composed.

EXAMPLE 1

18.3 cm×17.8 cm×0.03 cm samples of 3003 aluminum alloy were prepared for electrotreatment by degreasing with Ridoline 57, Amchem Products, an inhibited alkaline degreaser.

The degreased samples were then etched with about 1.0 N NaOH for 10–15 seconds.

After etching, a sample was water washed and dried with a jet of air. The sample was clamped to a conducting bar and suspended between two lead plates at about 20 cm from these plates in an insulated tank. The tank contained about 8 liters of a solution of 50 g/l $H_2SO_4$; 50 g/l $H_3PO_4$ and 0.5% polyvinyl phosphonic acid (PVPA).

Using a D.C. output, the aluminum was made anodic and the lead electrodes were made cathodic. The temperature of the bath was ambient but remained at 22° C.±2° C. for the test. The current was turned on with the voltage preset to 10 VDC. The electrotreatment was run for 60 seconds. Initial amperage rose to 5 amps but dropped to a 1–2 amps level very rapidly and remained at that level for the duration of the treatment. The contact was broken, the plate was removed from the bath and was rinsed with water and finally blotted dry.

The aluminum oxide-organic complex surface film weight was 108 mg/m$^2$ as determined by gravimetry before and after stripping with a chromic acid/phosphoric acid solution. Hydrophilicity of the surface was tested by applying a heavy rub-up ink without the benefit of water using a dry applicator pad.

The plate was considerably cleaner than conventionally prepared plates when immediately dry inked and water washed.

Several drops of potassium zincate solution (vide supra) were placed on the surface. The zinc ions are reduced to zinc metal at the aluminum oxide-organic film/metal interface thus giving a vivid dark spot signifying the end of the test.

The surface produced in this example required 35–40 seconds to the end point. By contrast, standard anodized, thermally treated (PVPA) plates took 25–30 seconds.

Finally, the plate was coated with a solution containing a pigment, polyvinyl formal binder and a diazonium condensation product of U.S. Pat. No. 3,867,147. When exposed through a standard negative flat and developed with an aqueous alcohol developer, the background cleaned out easily leaving a vivid image in the explosed areas.

Using a 21-step Stouffer stepwedge, exposure was made to give a solid six after development with an aqueous alcohol developer.

Transmission electron microscopic (TEM) examination of the isolated aluminum oxide-organic film at 55,000× magnification showed a smooth surface without visible porosity.

EXAMPLE 2

A plate was prepared in like manner, as described in Example 1, except that the electrolyte was phosphoric acid at 75 g/l. At 30 VDC for 60 seconds a plate having an oxide weight of 871 mg/m$^2$ was obtained. The potassium zincate end point was about 2 minutes and the result of dry inking was a severly scummed plate. The application of a light sensitive coating coating and subsequent exposure resulted in a scummed plate upon inking after developement in an aqueous alcohol developer. This is a prior art procedure.

EXAMPLE 3

A plate was prepared as described in Example 2. After removal from the anodizing bath the plate was rinsed and immersed in a bath of 0.2% PVPA (no strong inorganic acid) in tap water at a temperature of 150° F. for 30 seconds. After this treatment, the plate was rinsed and blotted dry.

The plate was found to have an oxide weight of 909 mg/m$^2$. The potassium zincate end point was about 2 minutes. Upon dry inking the plate, the ink was very difficult to remove with some areas remaining scummed. Upon coating the substrate with a light sensitive solution, previously described, and exposing, developing and inking, it was found that the plate was acceptable only with adequate dampening before inking. This is a prior art procedure.

EXAMPLE 4

A plate was degreased and etched as described in Example 1. The etched plate was immersed in a bath of 63 g/l $H_2SO_4$; 37 g/l $H_3PO_4$ and 1% PVPA. Electrotreatment for 30 seconds at 15 V. (10 amps initially dropped to 1–2 amps within 5 seconds) resulted in an aluminum oxide-organic film weight of about 500 mg/m$^2$. The potassium zincate time was 42 seconds and the dry inked sample could be reasonably cleaned with a wet applicator pad. Coated samples could be developed cleanly with aqueous alcohol developer.

TEM examination of the isolated alumino oxide-organic film showed a smooth, seemingly pore free, surface.

EXAMPLE 5

A plate was degreased and etched as described in Example 1. The etched plate was immersed in a bath of 23 g/l $H_3PO_4$ and 0.25% PVPA. Electrotreatment for 60 seconds at 30 volts D.C. resulted in an aluminum oxide-organic film weight of 198 mg/m$^2$. TEM analysis of the isolated aluminum oxide-organic film at 55,000× magnification showed essentially a structureless surface with some discontinuities. This surface was not tested functionally because of the discontinuities noted.

EXAMPLE 6

A plate was degreased and etched as described in Example 1. The sample was electrotreated in a bath of 23 g/l $H_3PO_4$ and 0.6% PVPA. The sample was treated at 20 VDC for 60 seconds to deposit 101 mg/m$^2$ of an aluminum oxide-organic film.

A potassium zincate time of 250 seconds was recorded for this sample. After dry inking the plate could be cleaned fairly readily with a damp applicator pad and coated samples could be readily developed with aqueous alcohol developer after exposure through a negative.

TEM examination of the isolated film at 55,000× magnification showed a smooth, uniform surface free of apparent porosity.

EXAMPLE 7

A plate was degreased and etched as described in Example 1. The sample was electrotreated in a bath of 75 g/l $H_2SO_4$; 25 g/l $H_3PO_4$ and 0.5% PVPA at 15 VDC for 60 seconds to give an aluminum oxide-organic film weight of about 500 mg/m$^2$. The potassium zincate end point was 30-35 seconds. A dry inked plate could be relatively cleaned by vigorous rubbing with a wet cotton applicator pad. Exposed and aqueous alcohol developed coated plates were fairly clean and scum free, but storage stability was limited.

TEM analysis at 55,000× magnification showed incipient porosity.

EXAMPLE 8

The sample was prepared and electrotreated as described in Example 1 except that the electrotreatment was run at 25 VDC for 60 seconds (amperage started at 25 amps and rapidly dropped to about 2 amps for duration of treatment). The aluminum oxide-organic film weight was 522 mg/m$^2$. The plate was comparable lithographically to that obtained in Example 1.

EXAMPLE 9

A sample was prepared and electrotreated as in Example 8 except that the treatment time was 120 seconds. The aluminum oxide-organic film weight was 1085 mg/m$^2$. The plate obtained was lithographically comparable to that obtained in Example 1.

EXAMPLE 10

A plate was degreased and etched as described in Example 1. The plate was electrotreated at 16 V. for 60 seconds in a bath of 100 g/l $H_3PO_4$ and 1% PVPA to give 113 mg/m$^2$ of aluminum oxide-organic film. 90 seconds was required to reach the potassium zincate end point.

After dry inking, the plate could be cleaned very easily by rinsing with water and lightly wiping with cotton applicator pad. A plate coated with a diazonium coating described in Example 1 could be developed cleanly and efficiently after exposure with aqueous alcohol developer.

EXAMPLE 11

A plate was electrotreated as in Example 10 except that 100 g/l $H_3PO_4$+1% phytic acid was used as the bath electrolyte.

The potassium zincate test took 100 seconds to completion. Plates rubbed up with dry ink could not be completely cleaned even with substantial rubbing with a wet applicator pad.

Coated plates exposed and developed with aqueous alochol developer remained clean after development.

EXAMPLE 12

A plate was prepared as in Example 4, except that the electrotreatment voltage was 50 VDC. The resulting plate was comparable lithographically to that of Example 4.

EXAMPLE 13

A plate was prepared as in Example 4, except that the electrotreatment temperature was 40° C. The resulting plate was comparable lithographically to that of Example 4.

What we claim is:

1. A process for preparing an element comprising
(a) cleaning a metal article,
(b) electrolyzing said metal article made anodic using direct current in an aqueous electrolytic solution having dissolved therein a mixture of electrolytes comprising:
i. a water-soluble organic acid or mixture of two or more water-soluble organic acids selected from the group consisting of organic phosphoric acids, sulfonic acids, phosphonic acids, diethylene diamine penta acetic acid, ethylene diamine tetra acetic acid, hydroxyethyl ethylene diamine triacetic acid, and nitrilo triacetic acid; and
ii. a strong inorganic acid comprising a phosphorus oxo acid having POH groups in which the hydrogen atom is ionizable under electrolytic conditions sufficient to form an insoluble substantially non-porous metal oxide-organic complex, including said organic acid, bonded to the surface of said metal article.

2. The process of claim 1, wherein said phosphorus oxo acid is phosphoric acid.

3. The process of claim 2, wherein said phosphorus oxo acid is phosphorous acid.

4. The process of claim 1, wherein said water-soluble organic acid is selected from the group consisting of the condensation product of benzene phosphonic acid, 2-ethyl hexyl phosphonic acid, and mixtures of these acids.

5. The process of claim 1 wherein the metal article is composed of aluminum or one of its alloys.

6. The process of claim 1, wherein the metal article is composed of steel.

7. The process of claim 5, wherein said water-soluble organic acid is nitrilo triacetic acid.

8. The process of claim 5, wherein said water-soluble organic acid is a condensation product of benzene phosphonic acid and formaldehyde.

9. The process of claim 5, wherein said water-soluble organic acid is a copolymer of methylvinyl ether and maleic acid.

10. The process of claim 5, wherein said water-soluble organic acid is polyvinyl sulfonic acid.

11. The process of claim 5, wherein said water-soluble organic acid is polystyrene sulfonic acid.

12. The process of claim 5, wherein said water-soluble organic acid is phytic acid.

13. The process of claim 5, wherein said water-soluble organic acid is alginic acid.

14. The process of claim 5, wherein said water-soluble organic acid is poly-n-butyl benzene sulfonic acid.

15. The process of claim 5, wherein said water-soluble organic acid is polydiisopropyl benzene sulfonic acid.

16. The process of claim 5, wherein said water-soluble organic acid is polyvinyl phosphonic acid.

17. The process of claim 5, wherein said water-soluble organic acid is dodecyl polyoxyethylene phosphonic acid.

18. The process of claim 5, wherein said water-soluble organic acid is dinonyl naphthalene disulfonic acid.

19. The process of claim 5, wherein said water-soluble organic acid is 2,2'-dinitro-4,4'-stilbene disulfonic acid.

20. The process of claim 5, wherein said water-soluble organic acid is diisopropyl polynaphthalene disulfonic acid.

21. The process of claim 5, wherein said water-soluble organic acid is 2-ethyl hexyl phosphonic acid.

22. The process of claim 5, wherein said water-soluble organic acid is dodecyl naphthalene disulfonic acid.

23. The process of claim 5, wherein said water-soluble organic acid is di-n-butyl naphthalene disulfonic acid.

24. The process of claim 5, wherein said water-soluble organic acid is polydecyl benzene sulfonic acid.

25. The process of claim 5, wherein said water-soluble organic acid is polyacrylic acid.

26. The process of claim 5, wherein said water-soluble organic acid is polymethacrylic acid.

27. The process of claim 5, wherein said water-soluble organic acid is diethylene diamine pentaacetic acid.

28. The process of claim 5, wherein said water-soluble organic acid is polynaphthalene sulfonic acid.

29. The process of claim 5, wherein said water-soluble organic acid is ethylenediamine tetraacetic acid.

30. The process of claim 5, wherein said water-soluble organic acid is hydroxyethyl ethylene diamine triacetic acid.

31. The process of claim 1, wherein said electrolyte solution has dissolved therein a mixture of two or more said organic acids.

32. The process of claim 1, wherein said inorganic acid is phosphoric acid and said electrolyte further comprises sulfuric acid.

33. The process of claim 30, wherein said organic acid is present at a concentration of between about 0.5% and about 30% and said electrolysis is conducted at a voltage of at least about 5 volts, an average current density of between about 0.2 amperes/dm$^2$ and about 6 amperes/dm$^2$, a time of between 0.8 minutes and about 5 minutes, and a temperature of between about −2° C. and about 60° C.

34. The process of claim 30, wherein said organic acid is present at a concentration of at least about 0.5%, said eiectrolysis is conducted at a voltage of between about 10 volts and about 30 volts, the average current density is between about 0.2 amperes/dm and about 6 amperes/dm$^2$, the time is between about 0.16 minutes and about 1 minute, and the temperature is between about 10° C. and about 35° C.

35. The process of claims 32, wherein said organic acid is the condensation product of benzene phosphonic acid and formaldehyde.

36. The process of claims 32, wherein said organic acid is a phytic acid.

37. The process of claims 32, wherein said organic acid is polyvinyl phosphonic acid.

38. The process of claims 32, wherein said organic acid is 2-ethyl hexyl phosphonic acid.

39. The process of claim 3, wherein said metal article is lithographic aluminum sheet, and as an additional step, a light sensitive coating is applied to the surface of said insoluble metal oxide-organic complex.

40. The process of claim 39, wherein the light sensitive coating contains a sensitizer selected from the group consisting of o-quinone diazides condensation products of the condensation of aromatic diazonium compounds, and photopolymers.

41. The process of claim 39, wherein said sensitizer is an o-quinone diazide.

42. The process of claim 39, wherein said sensitizer is a product of the condensation of aromatic of a diazonium compound.

43. The process of claim 39 wherein said sensitizer is a photopolymer.

44. The process of claim 40, wherein said organic acid is polyvinyl phosphonic acid.

45. The product produced by the process of claim 5.

46. The product produced by the process of claim 4.

47. The product produced by the process of claim 16.

48. The product produced by the process of claim 33.

49. The product produced by the process of claim 34.

50. The product produced by the process of claim 39.

51. The product produced by the process of claim 40.

52. The product produced by the process of claim 41.

53. The product produced by the process of claim 42.

54. A metal article having a substantially nonporous, insoluble metal oxide-organic layer comprising anodic oxide combined with one or more organic acids selected from the group consisting of sulfonic acid, phosphonic acid, organic phosphoric acids; diethylene diamine penta acetic acid, ethylene diamine tetra acetic acid, hydroxyethyl ethylene diamine triacetic acid, and nitrilo triacetic acid.

55. A metal article having a substantially nonporous insoluble metal oxide-organic layer thereupon, said layer comprising anodic oxide combined with an organic acid selected from the group consisting of the condensation product of benzene phosphonic acid and formaldehyde, phytic acid, polyvinyl phosphonic acid, 2-ethyl hexyl phosphonic acid and mixtures of these acids.

56. The product of claim 54, wherein said article is composed of a metal selected from the group consisting of aluminum and its alloys, and steel.

57. The product of claim 55, wherein said metal is aluminum and said metal oxide-organic layer has a light sensitive coating thereupon.

58. The product of claim 57, wherein said light sensitive coating contains a sensitizer selected from the group consisting of o-quinone diazides, condensation products of an aromatic diazonium compound and photopolymers.

* * * * *